US005697547A

United States Patent [19]

Kraus

[11] Patent Number: 5,697,547

[45] Date of Patent: Dec. 16, 1997

[54] FOLDED SINGLE SHEET MAILER

[75] Inventor: Manfred G. Kraus, Port Moody, Canada

[73] Assignee: 478336 B.C. Ltd., Richmond, Canada

[21] Appl. No.: 591,001

[22] Filed: Jan. 24, 1996

Related U.S. Application Data

[62] Division of Ser. No. 140,458, Oct. 25, 1993, Pat. No. 5,501,392.

[51] Int. Cl.[6] ..... B65D 27/06; B65D 27/34

[52] U.S. Cl. ..... 229/92.1; 229/305; 229/314

[58] Field of Search ..... 229/92.1, 92.3, 229/305, 92.5, 92.7, 313, 314

[56] References Cited

U.S. PATENT DOCUMENTS 3,606,138 9/1971 Allison ..... 229/92.7
4,944,449 7/1990 Schmidt ..... 229/92.7
5,174,491 12/1992 Taylor et al. ..... 229/314
5,288,015 2/1994 Sauerwine ..... 229/305

FOREIGN PATENT DOCUMENTS 516962 1/1940 United Kingdom ..... 229/92.1

*Primary Examiner*—Stephen P. Garbe
*Attorney, Agent, or Firm*—Elbie R. de Kock

[57] ABSTRACT

A folded single sheet mailer is provided which comprises a rectangular sheet (12) provided with transverse and longitudinal lines of perforation and transverse and longitudinal glue lines. The sheet (12) is folded onto itself along a transverse fold line (14) which is offset with respect to the center of the sheet (12). The sheet (12) is then folded along a plurality of secondary fold lines (28,30) and sealed to produce an outgoing envelope which can be mailed. The mailer includes a return envelope for use when placing an order.

6 Claims, 18 Drawing Sheets

FOLDED SINGLE SHEET MAILER

CROSS REFERENCE TO RELATED APPLICATION

This application is a division of U.S. patent application Ser. No. 08/140,458 filed Oct. 25, 1993, now U.S. Pat. No. 5,501,392, the entire contents of which is incorporated herein by reference.

FIELD OF THE INVENTION

This invention relates to a folded single sheet mailer and a method of making such a mailer.

BACKGROUND OF THE INVENTION

Single sheet mailers are formed from rectangular sheets of paper on which particular information, such as the name and address of an addressee, advertising material and order forms, as well as a return mailing address, is printed. Printed matter normally appears on both sides of the mailer sheet and once printed, the mailer is then glued, perforated and folded to form an outgoing envelope which can be mailed.

It is an object of the present invention to provide an improved single sheet mailer which provides sufficient space for printed material thereon. It is also an object of the invention to provide a mailer that is adequately sealed so that it complies with first class mail requirements.

SUMMARY OF THE INVENTION

According to the invention, there is provided a folded single sheet mailer comprising a rectangular sheet having a first pair of opposed ends, a second pair of opposed ends, an outer face and an inner face, said sheet being folded on itself transverse to said first pair of ends along a line offset from the middle of said sheet to provide one fold ply extending beyond the other fold ply, a first line of perforation in said one ply in the portion extending beyond the other fold ply, said first line of perforation extending transverse to said first pair of ends, a first glue line on said inner face on the portion extending beyond the other ply, a second glue line extending transversely of said first glue line adjacent one of said first pair of opposed ends, a second line of perforation extending along said second glue line from said transverse fold to one of said second pair of opposed ends, a pair of superimposed lines of perforation, respectively, in said one ply and in said other fold ply adjacent said transverse fold line and a third glue line on said outer face between said superimposed lines of perforation and said transverse fold line, said sheet further being folded on itself along a plurality of spaced apart secondary fold lines transversely of said transverse fold line to provide an outgoing envelope which is sealed along one pair of its opposite ends and which is openable by tearing along said superimposed lines of perforation and said first line of perforation.

Also according to the invention, there is provided a folded single sheet mailer comprising a rectangular sheet having a first pair of opposed ends, a second pair of opposed ends, an outer face and an inner face, said sheet being folded on itself transverse to said first pair of ends along a line offset from the middle of said sheet to provide one fold ply extending beyond the other fold ply, a first line of perforation in said one ply in the portion extending beyond the other fold ply, said first line of perforation extending transverse to said first pair of ends, a first glue line on said inner face on the portion extending beyond the other ply, a pair of superimposed lines of perforation, respectively, in said one ply and in said other fold ply adjacent said transverse fold line and a second glue line on said outer face between said superimposed lines of perforation and said transverse fold line, said sheet further being folded on itself along three spaced apart secondary fold lines transversely of said transverse fold line to provide an outgoing envelope which is sealed along one pair of its opposite ends and which is openable by tearing along said superimposed lines of perforation and said first line of perforation.

Further according to the invention, there is provided a folded single sheet mailer comprising a rectangular sheet having a first pair of opposed ends, a second pair of opposed ends, an outer face and an inner face, said sheet being folded on itself transverse to said first pair of ends along a pair of spaced transverse fold lines, a pair of superimposed lines of perforation adjacent each of said transverse fold lines, and said sheet further being folded along at least two longitudinal fold lines extending longitudinally of said first pair of ends to provide an outgoing envelope which is openable by tearing along said superimposed lines of perforation.

Further objects and advantages of the invention will become apparent from the description of preferred embodiments of the invention below.

BRIEF DESCRIPTION OF THE DRAWINGS

The invention will now be described by way of examples, with reference to the accompanying drawings, in which.

DETAILED DESCRIPTION OF THE PREFERRED EMBODIMENTS

Figure 1:
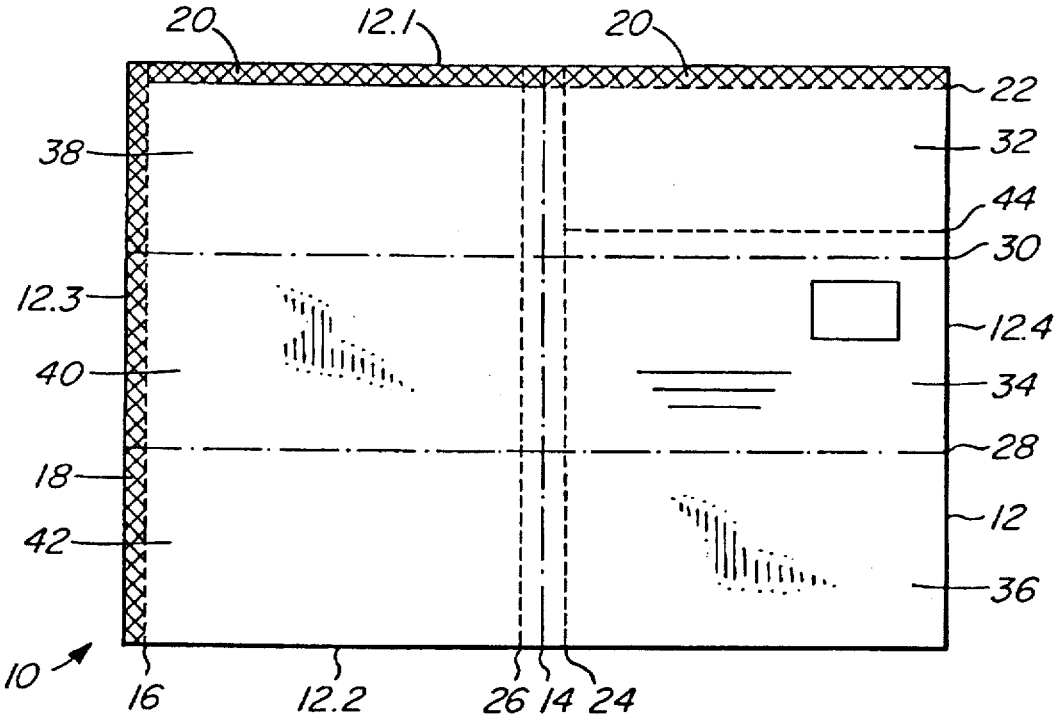
FIG. 1 is a plan view of an inner face of a single sheet mailer according to one embodiment of the invention, shown in an unfolded condition.
Figure 2:
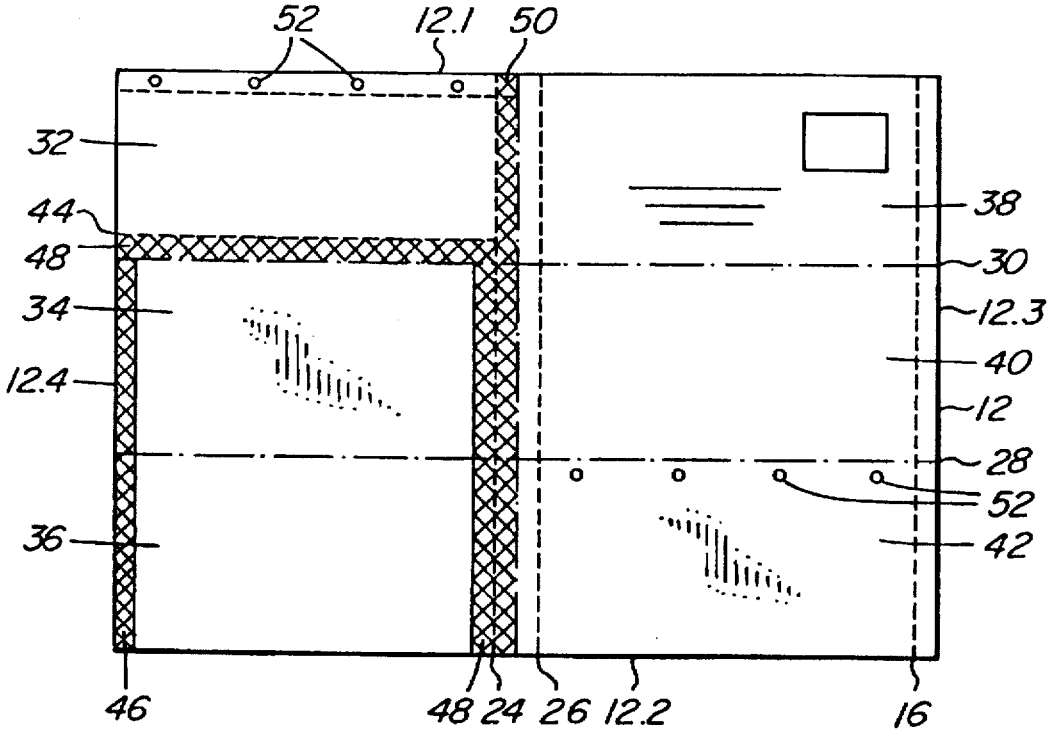
FIG. 2 is a plan view of the outer face of the single sheet mailer of FIG. 1.

With reference to FIGS. 1 and 2, reference numeral 10 generally indicates a single sheet mailer which is formed from a rectangular sheet of paper 12 which has a first pair of opposed ends 12.1, 12.2 and a second pair of opposed ends 12.3 and 12.4. The sheet 12 is folded on itself transverse to the first pair of ends 12.1 and 12.2 along a transverse fold line 14 which is slightly offset from the middle of the sheet 12 so that one fold ply extends beyond the other fold ply when the sheet 12 is folded along the line 14.

A first line of perforation 16, indicated by a broken line, is provided extending transverse to the first pair of ends 12.1 and 12.2. The perforation 16 is provided in the ply which extends beyond the other ply. A first glue line 18, indicated by cross-hatching, is provided on the inner face of the sheet 12. The glue line 18 extends between the first line of perforation 16 and the end 12.3 of the sheet 12.

A second glue line 20 is provided on the inner face of the sheet 12 adjacent the end 12.1. A second line of perforation 22 extending from the fold line 14 to the end 12.4 is provided adjacent the glue line 20. Although the glue line 20 is shown to extend along the entire length of the end 12.1, it can, of course, extend only along half the length. A pair of superimposed lines of perforation 24 and 26 are further provided adjacent the fold line 14, as shown.

After being folded along the fold line the sheet 12 is further folded on itself along two further or secondary fold lines 28 and 30. The sheet 12 is first folded along the line 28 and then along the line 30.

Folding the sheet 12 along the fold lines 28 and 30 results in the formation of three side-by-side elongate panels on each side of the transverse fold line 14. These panels are respectively indicated by reference numerals 32, 34, 36, 38, 40 and 42.

As indicated, the name and address of a recipient of the mailer 10 is printed on the outer face of the sheet 12 in panel 38. A return address is printed on the inner face in panel 34. A longitudinal line of perforation 44 is provided in the panel 32 to form a flap for the return envelope which is formed by panels 34 and 36 folded onto each other along fold line 28. Glue lines 46 and 48 are provided along the transverse ends of the panels 34 and 36. These glue lines are of a remoistenable glue so that the return envelope can be formed by the recipient after separating the panels 34 and 36 from the rest of the sheet 12 by tearing along the perforated line 44. Remoistenable adhesive is also provided on the flap as indicated by reference numeral 48.

A further glue line 50 is provided on the outer face of the sheet 12 extending along one side of the transverse fold 14. The glue line 50 cooperates with the glue line 18 to form two spaced glue lines when the sheet 12 is folded along the transverse fold line 14 and it is by means of these glue lines that the mailer 10 is sealed when folded along the secondary fold lines 28 and 30 to form the outgoing envelope. Two cooperating lines of glue spots 52 are provided on the panels 32 and 42, respectively, for forming a seal along the top longitudinal edge of the outgoing envelope. Thus, a completely sealed mail item is produced which can be sent by first class mail, if desired.

When received by a recipient, the mailer 10 is opened by tearing along the superimposed lines of perforation 24, 26 and along the line of perforation 16. In addition, the top edge of the envelope is opened by sliding a finger under the edge to break the seal of the glue spots 52.

Advertising material or other information can be printed on the sheet 12. A return order form can conveniently be printed on the panel 32, which panel can be separated from the rest of the sheet 12 by tearing along the perforated line 22.

Figure 3:
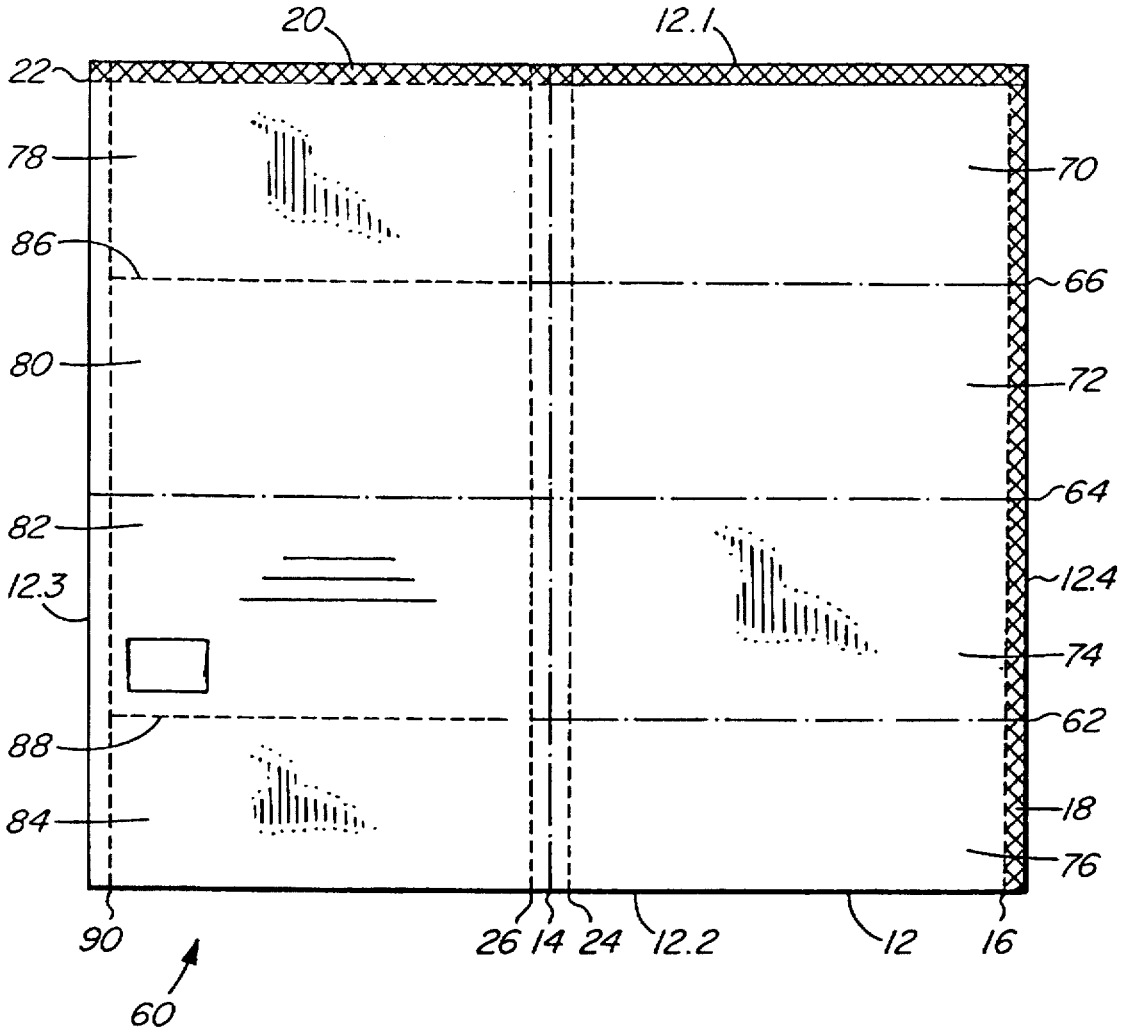
FIG. 3 is a plan view of an inner face of a single sheet mailer according to another embodiment of the invention, shown in an unfolded condition.
Figure 4:
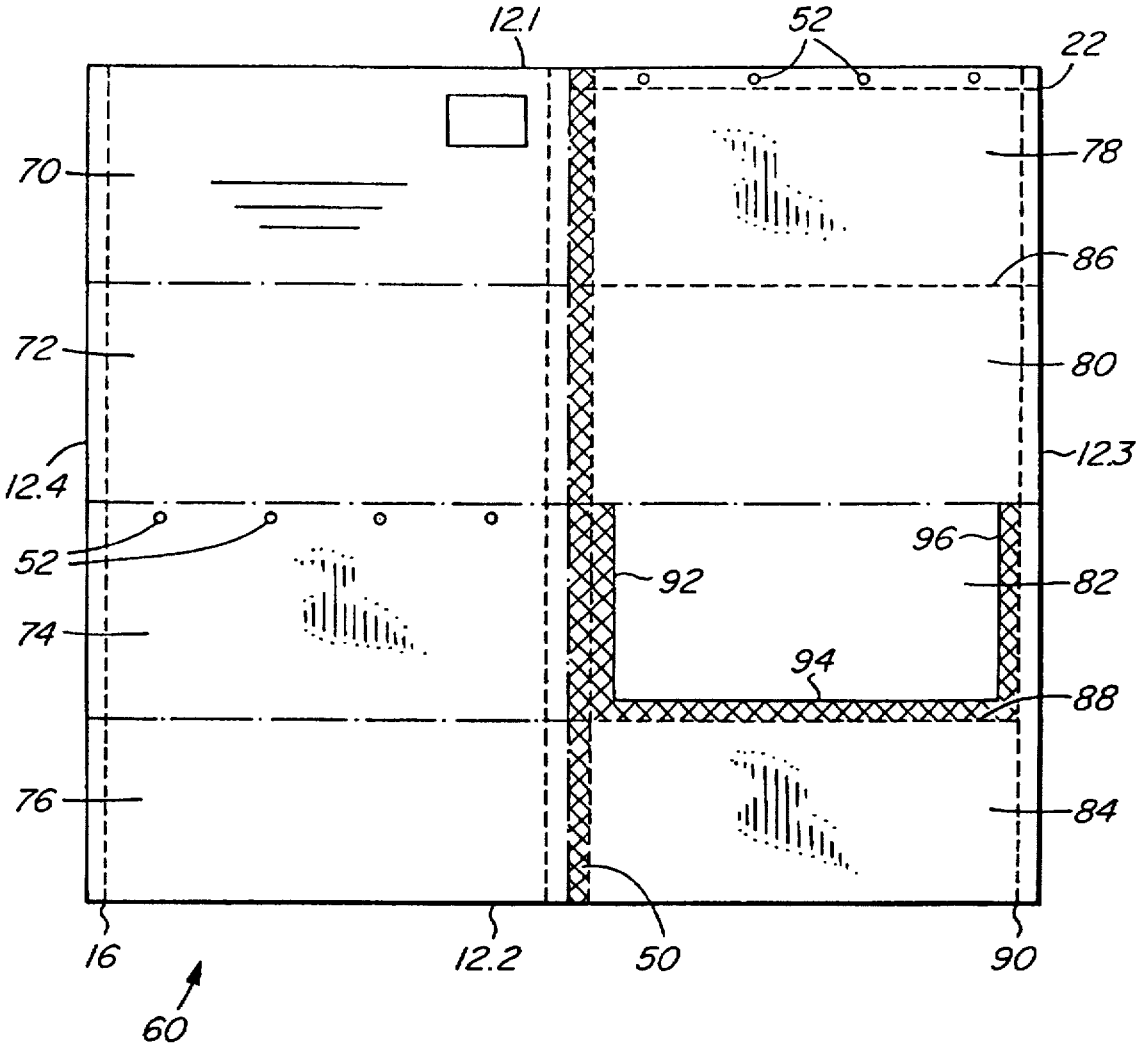
FIG. 4 is a plan view of the outer face of the single sheet mailer of FIG. 3.

With reference now to FIGS. 3 and 4, a single sheet mailer 60 according to another embodiment of the invention is shown. Parts of the mailer 60 which correspond with the mailer 10 are indicated by like reference numerals. The mailer 60 is again formed from a rectangular sheet 12 with opposite pairs of ends 12.1, 12.2, 12.3, 12.4 and it is folded along a fold line 14 which is transverse to the ends 12.1 and 12.2. The sheet 12 further has a line of perforation 16, glue lines 18, 20 and 50 and a line of perforation 22, as well as superimposed lines of perforation 24 and 26, like the mailer 10 of FIG. 1.

Instead of two secondary fold lines 28, 30 like the mailer 10 of FIG. 1, the mailer 60 has three secondary fold lines 62, 64 and 66 so that four panels are formed on each side of the transverse fold line 14. These panels are indicated by reference numerals 70, 72, 74, 76, 78, 80, 82 and 84. If desired, the panels 76 and 84 can be of a somewhat smaller height than the other panels, as shown in FIGS. 3 or 4. However, the panels 76 and 84 can also be of substantially the same size as the other panels. The name and address of a recipient is printed on panel 70 on the outer face of the sheet 12 and a return address is printed on the panel 82 on the inner face of the sheet 12. Lines of perforation 86 and 88 are provided along a part of the fold lines 66 and 62, respectively. A further line of perforation 90 is provided along the edge 12.3.

After being folded along the transverse fold line 14, the sheet 12 is sequentially folded along the fold lines 62, 64 and 66 to form the outgoing envelope to be mailed. The opposite ends of the outgoing envelope are sealed by means of the glue lines 18 and 50, as well as by the spaced glue spots 52 which, in this embodiment, are provided on the panels 74 and 78, respectively. Strips of remoistenable glue 92, 94, 96 are provided on the panel 82 so that a return envelope can be formed by the recipient after separating the panels 80 and 82 from the rest of the sheet 12. If desired, an order form can be printed on the panels 80 and 82 on the inside of the return envelope. The return envelope can then be used for sending a cheque with the order.

Like the mailer 10 of FIG. 1, the mailer 60 is opened by the recipient by tearing along the line of perforation 16 and superimposed lines of perforation 24, 26 and breaking the glue spots 52.

Figure 5:
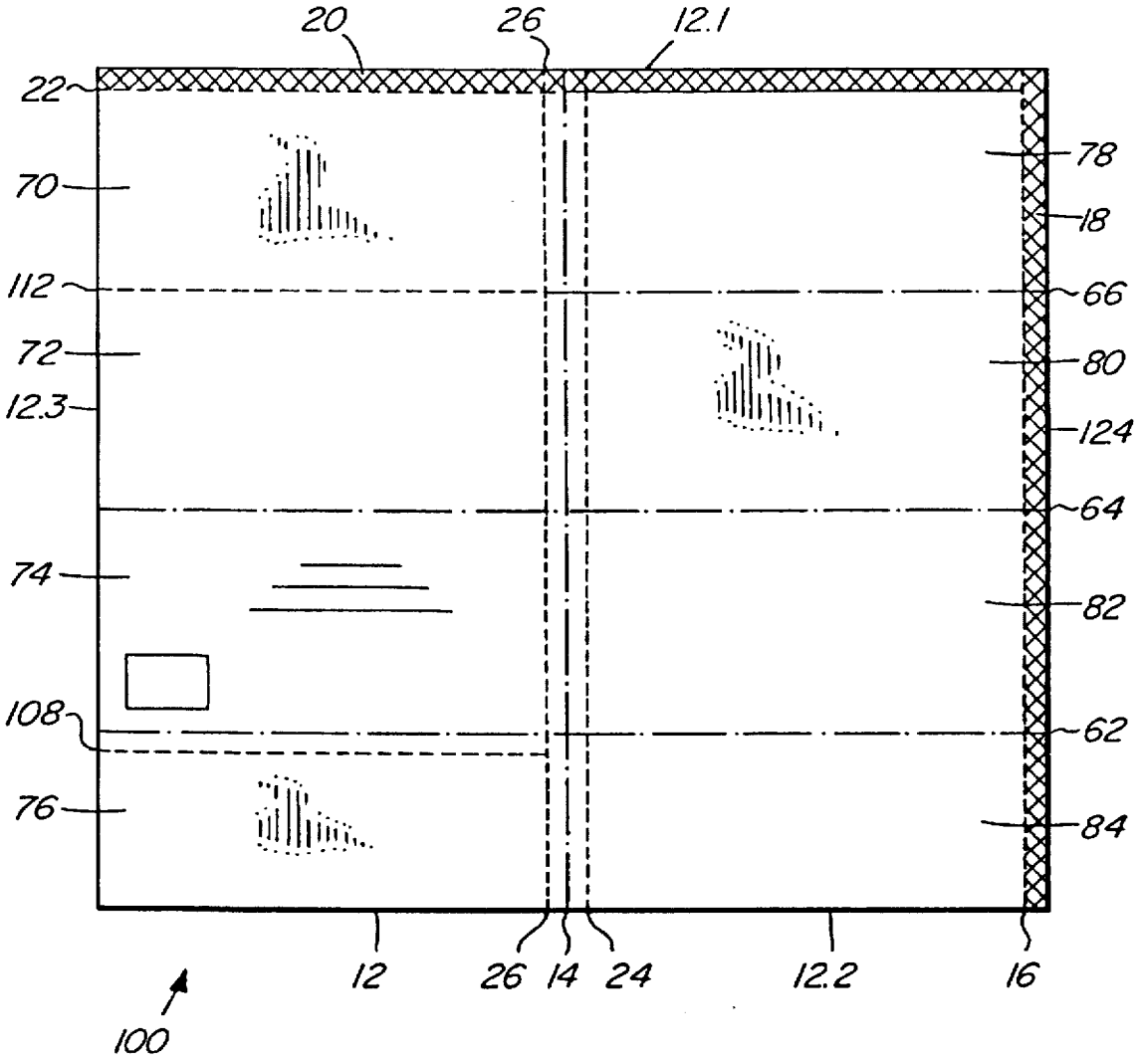
FIG. 5 is a plan view of an inner face of a single sheet mailer according to a further embodiment of the invention, shown in an unfolded condition.
Figure 6:
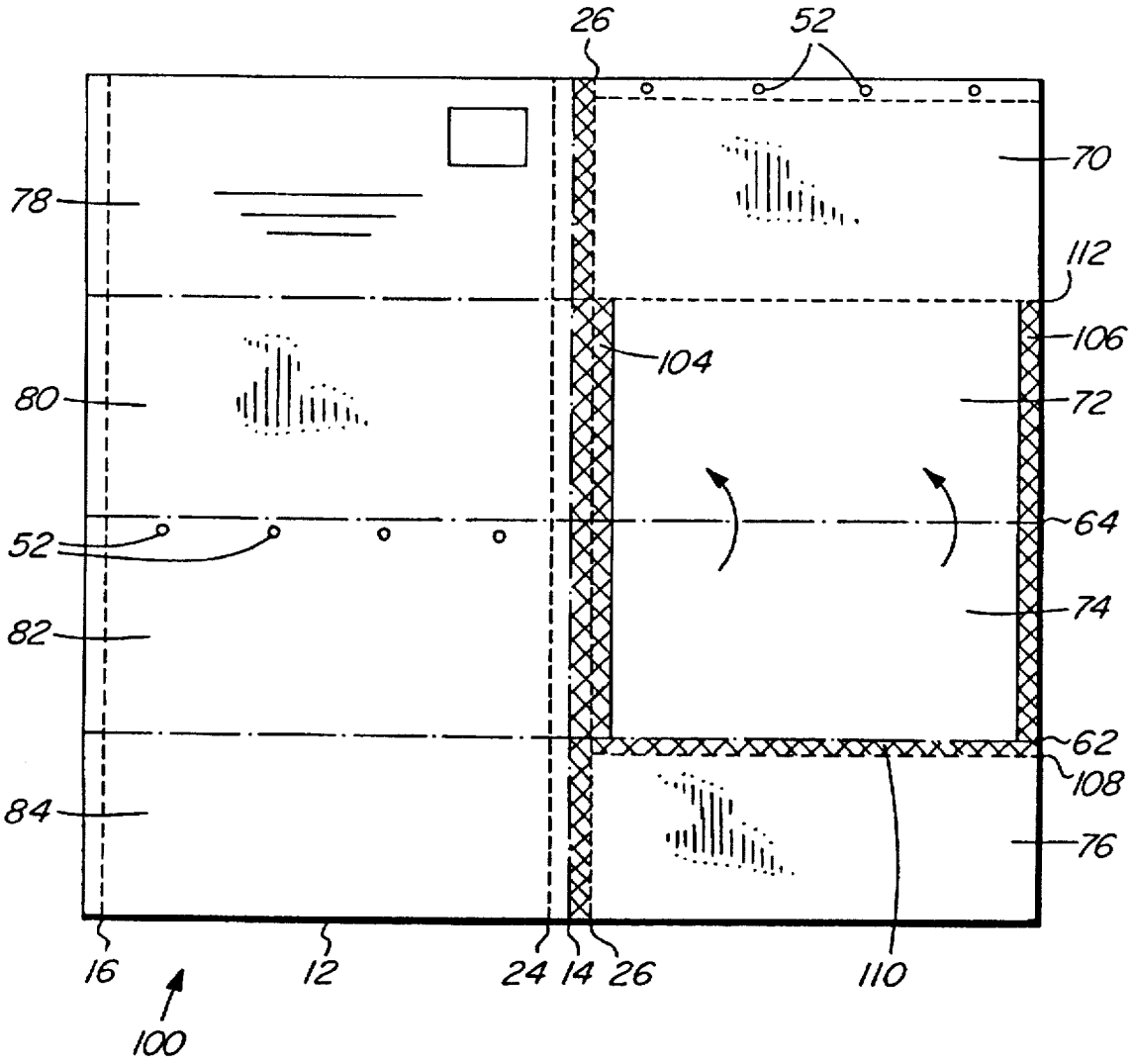
FIG. 6 is a plan view of the outer face of the mailer of FIG. 5.
Figure 7:
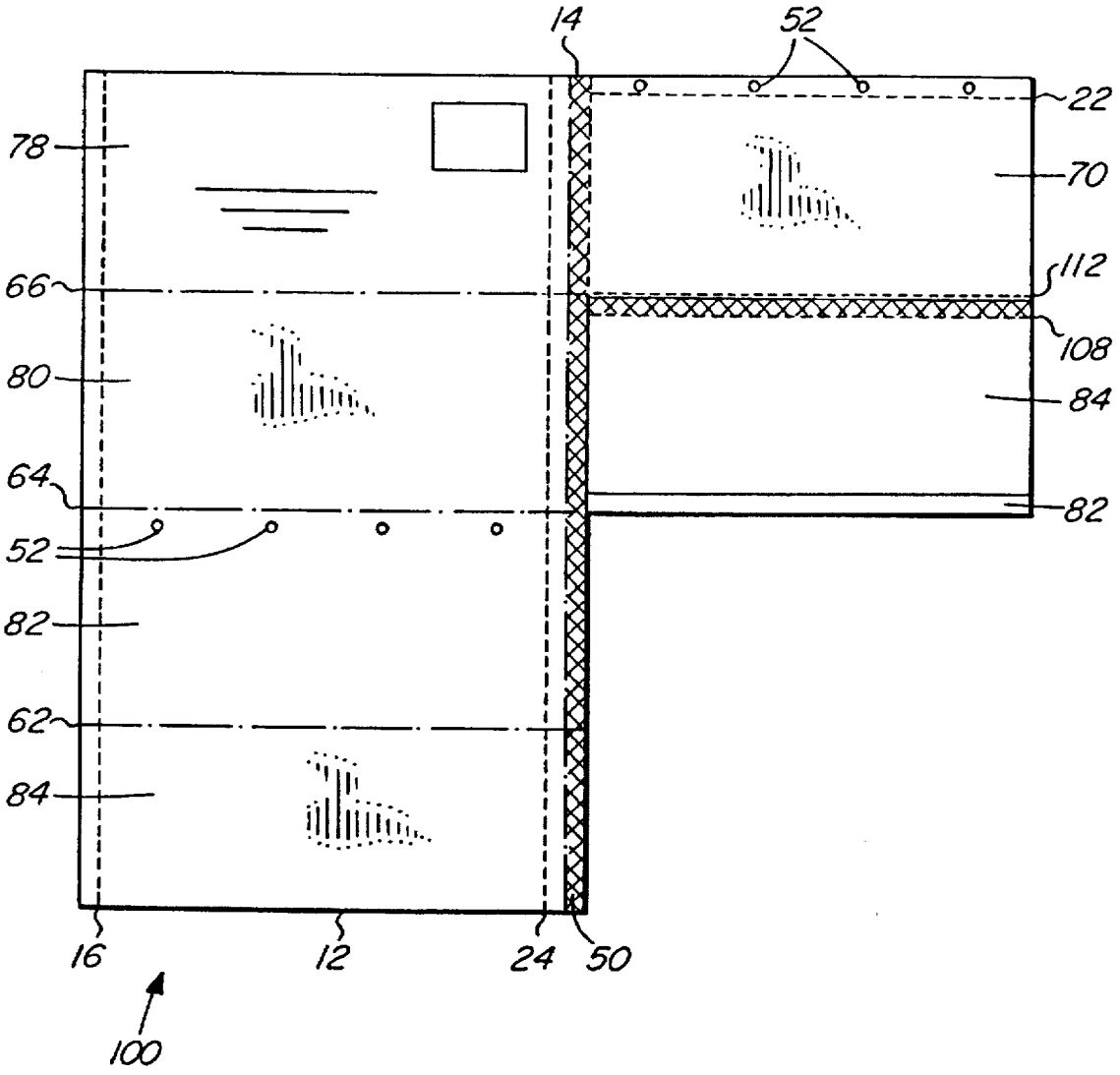
FIG. 7 is a plan view of the mailer of FIG. 5 in a partially folded condition.

With reference to FIGS. 5 to 7, a mailer 100 according to an alternative embodiment of the invention is shown. The mailer 100 is in many respects similar to the mailer 60 and like reference numerals are used to indicate like parts. The description of these parts will not be repeated.

The mailer 100 differs from the mailer 60 in that it provides a return envelope which is already formed when received by the recipient. For this purpose, the panels 74 and 76 are separated along part of the line of perforation 26 extending along the sides of the panels 74 and 76. Glue lines 104 and 106 are provided along the opposite transverse ends of the panels 72 and 74 and the return envelope is formed by folding the panel 74 onto panel 72 along the fold line 64 and sealing the opposite ends by means of the gum strips 104 and 106 to form the return envelope. A longitudinal line of perforation 108 is provided in the panel 76 for forming the sealing flap of the return envelope and it is provided with a strip of remoistenable adhesive 110. The sheet 12 after the return envelope has been formed, is shown in FIG. 7. To complete the mailer 100, it is next folded along the transverse fold line 14 and then sequentially along the fold lines 62, 64 and 66 like the mailer 60. The mailer 100 is opened in a fashion similar to the mailer 60. Conveniently, a return order form can be printed on the panel 70. The recipient's name and address is printed on the panel 78 and the return address is printed on the panel 74. The return envelope is separated from the rest of the sheet 12 by tearing along a line of perforation 112 provided along the fold line 66 between the panels 70 and 72.

Figure 8:
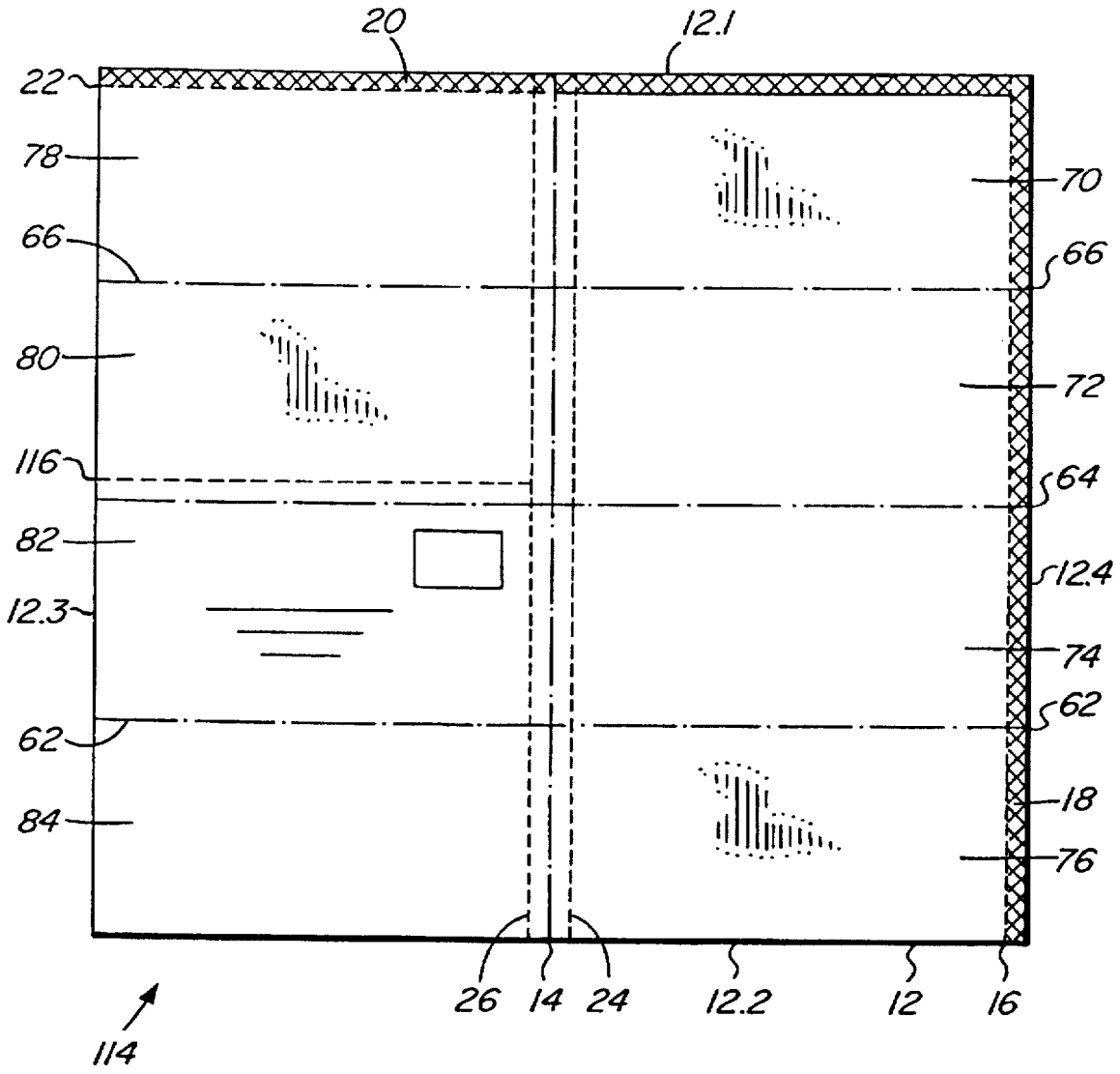
FIG. 8 is a plan view of an inner face of a single sheet mailer according to another embodiment of the invention, shown in an unfolded condition.
Figure 9:
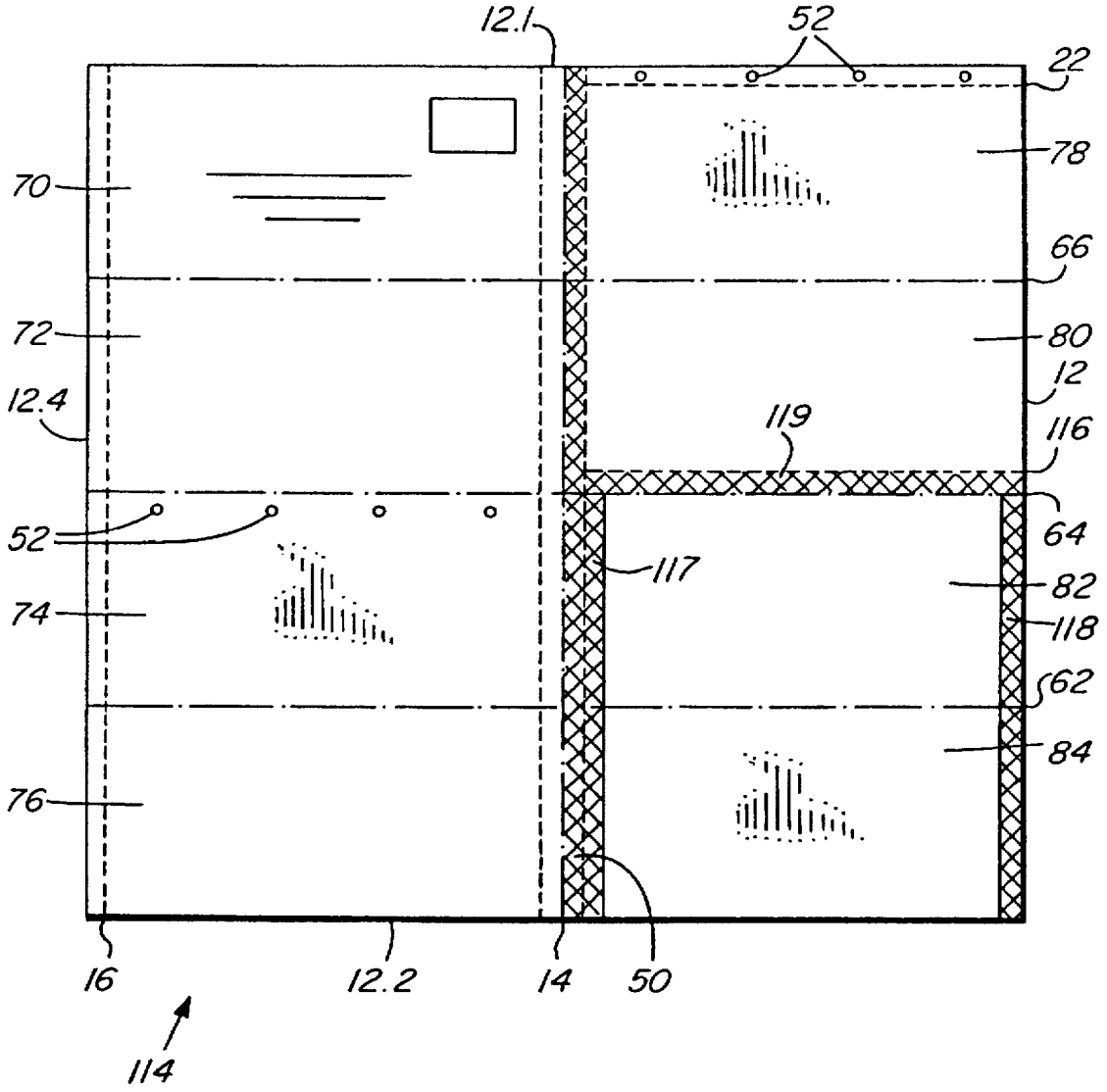
FIG. 9 is a plan view of the outer face of the single sheet mailer of FIG. 8.

With reference to FIGS. 8 and 9, a further mailer 114 according to another embodiment of the invention is shown. The mailer 114 differs from the mailer 100 in respect of the location of the return envelope. In this instance the return envelope is formed by folding the panel 84 onto the panel 82. A line of perforation 116 is provided in the panel 80 to form the flap of the return envelope. Glue lines 117 and 118 are provided along the transverse edges of the panels 82 and 84 for sealing the opposite ends of the return envelope. A line of remoistenable adhesive 119 is provided on the flap. An order form can conveniently be printed on the outer face of the sheet 12 on the panels 78 and 80. The recipient's name and address is printed on the panel 70 and the return address is printed on the panel 82, as shown.

Figure 10:
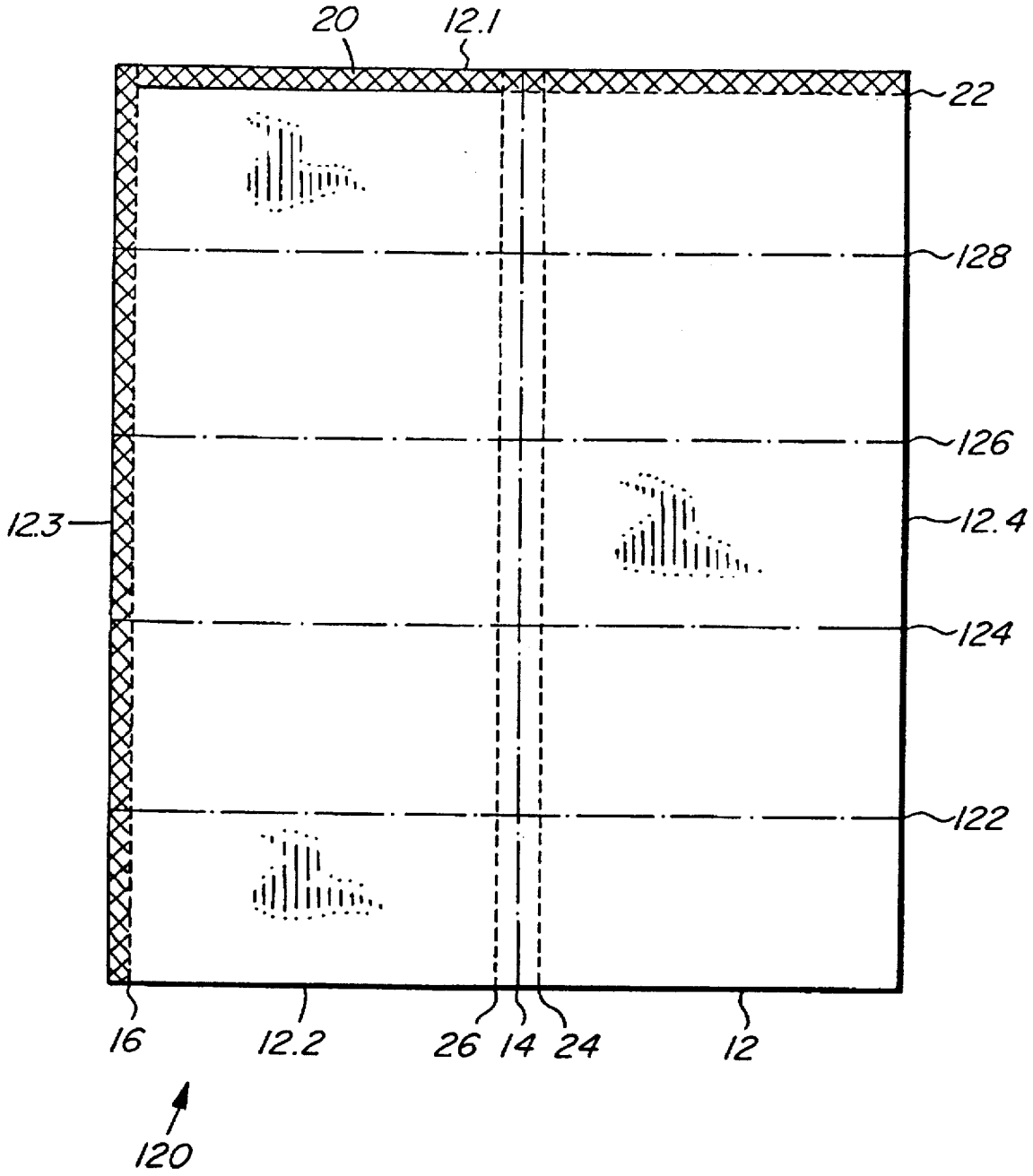
FIG. 10 is a plan view of a single sheet mailer according to another embodiment of the invention.
Figure 11:
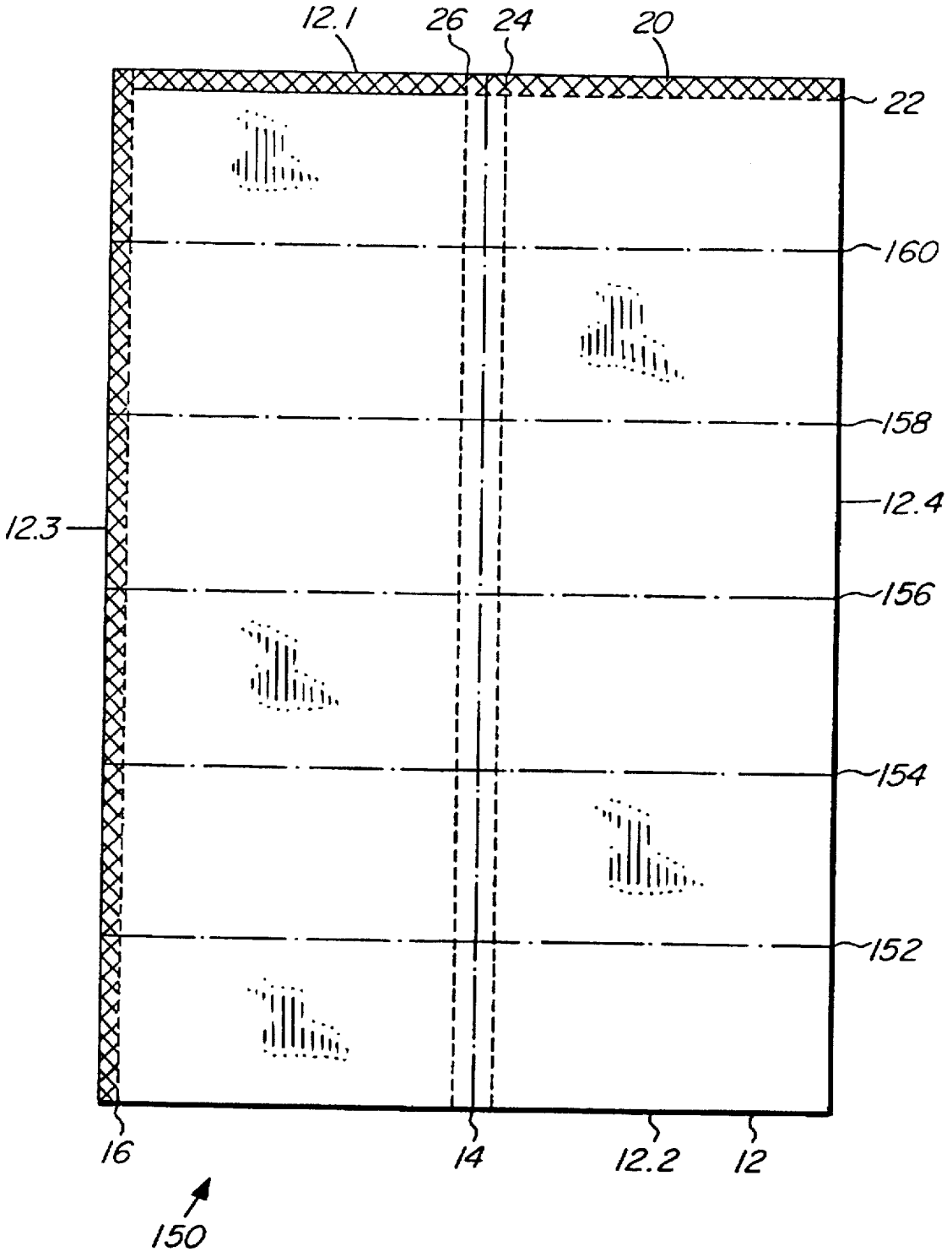
FIG. 11 is a plan view of a single sheet mailer according to a further embodiment of the invention.

With reference to FIGS. 10 and 11, two further mailers 120 and 150 according to the invention are shown. In each case, parts which correspond with those of the mailer 60 are indicated by like reference numerals. The mailer 120 is different from the mailer 60 in that, after being folded along the fold line 14, it is sequentially folded along four secondary fold lines 122, 124, 126 and 128 so that five elongate panels on each side of the fold line 14 are formed.

The mailer 150, after being folded along the fold line 14, is sequentially folded along five secondary fold lines, 152, 154, 156, 158 and 160 to form six elongate panels on each side of the fold line 14.

The mailers 120 and 150 may be provided with further lines of perforation and glue as desired to provide for a return envelope and order form, as described with reference to the mailer 10, 60 or 100.

Figure 12:
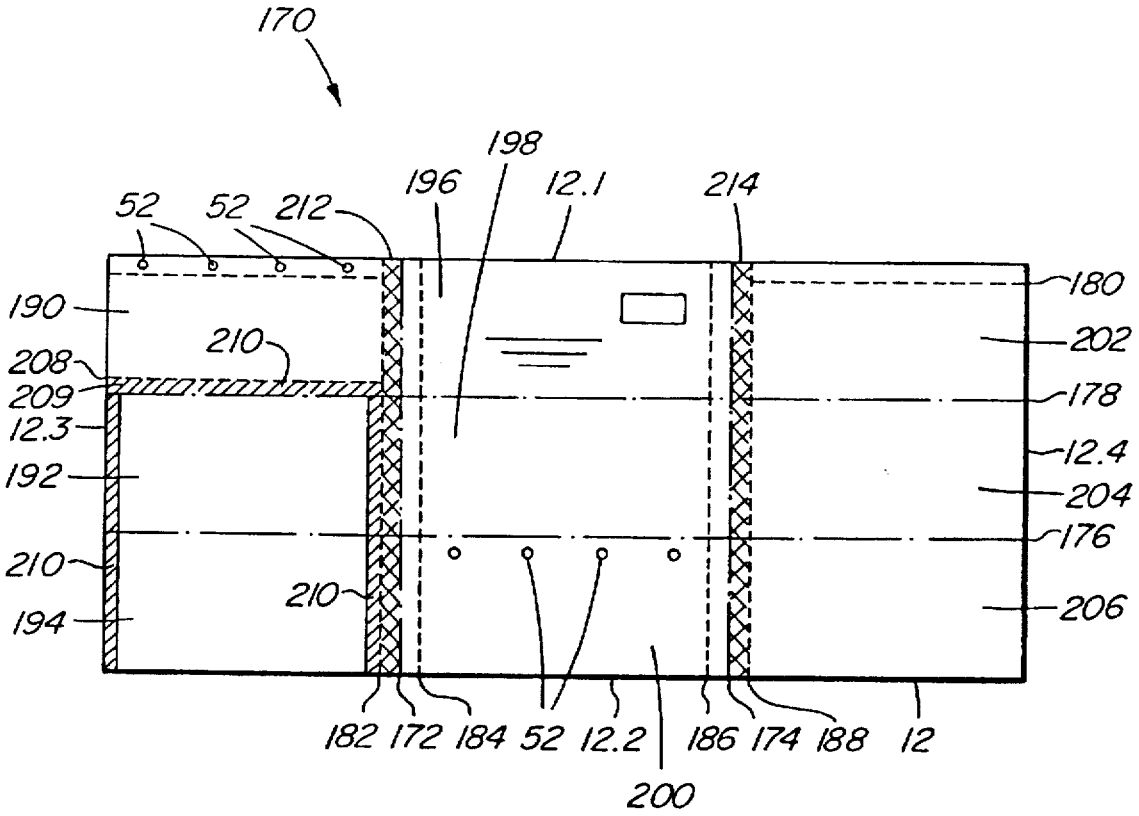
FIG. 12 is a plan view of the outer face of a single sheet mailer according to yet another embodiment of the invention.
Figure 13:
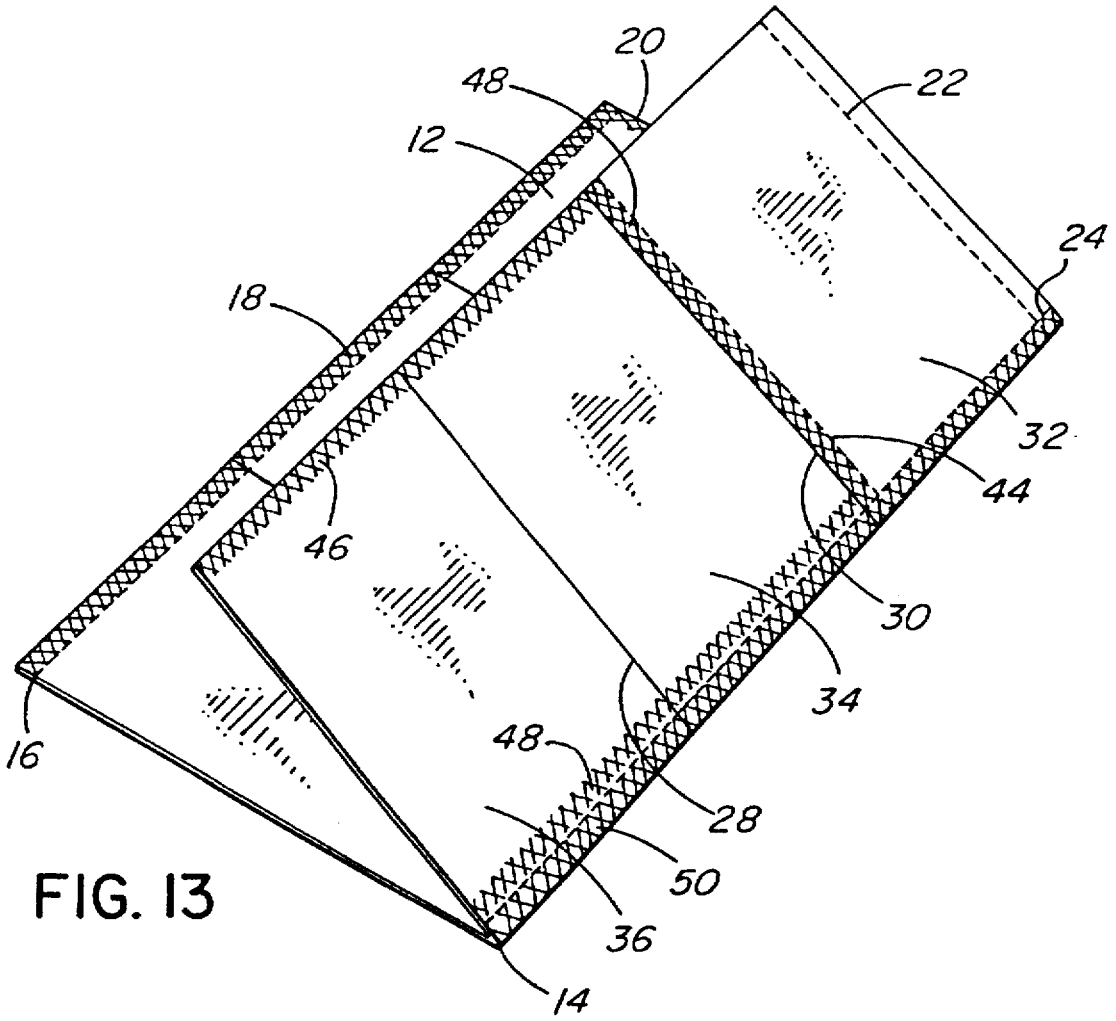
FIG. 13 is a perspective view of the mailer of FIG. 1 shown folded along its transverse fold line.
Figure 14:
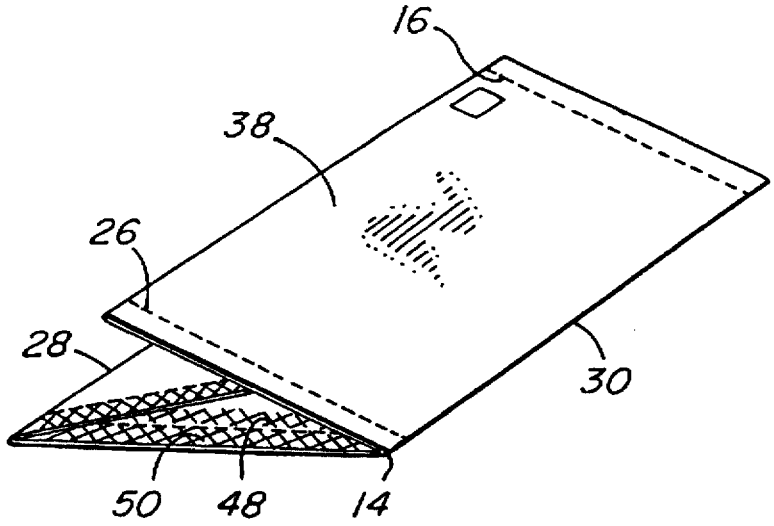
FIG. 14 is a perspective view of the mailer of FIG. 1 shown additionally folded about its two secondary fold lines.
Figure 15:
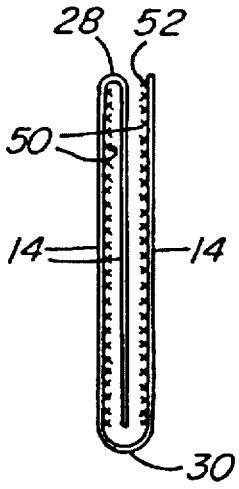
FIG. 15 is a cross section of the embodiment shown in FIG. 14 when folded flat.
Figure 16:
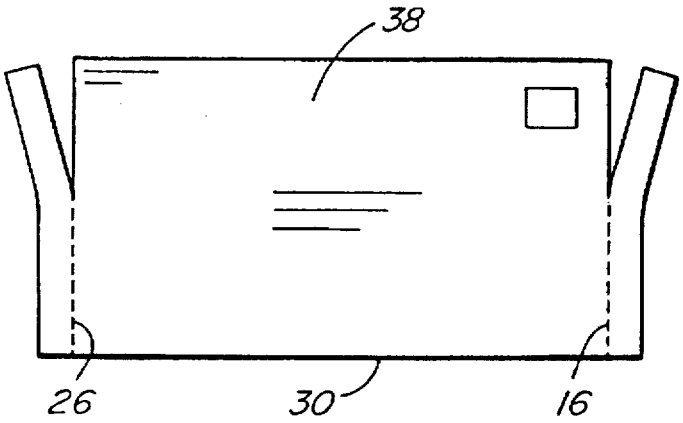
FIG. 16 is a front view of the mailer of FIG. 1, in a folded and sealed condition, and shown partially torn open.
Figure 17:
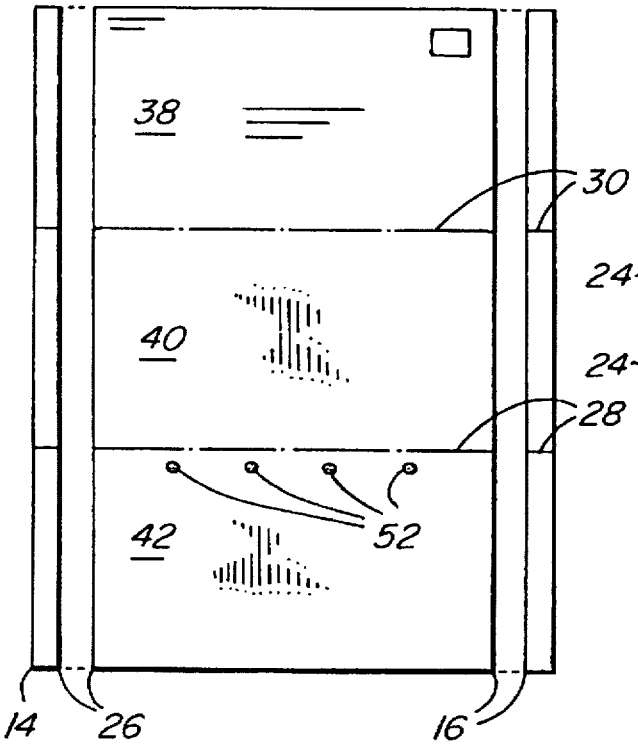
FIG. 17 is a plan view of the mailer of FIG. 16 showing the opposite perforated ends completely severed and the mailer being in an unfolded condition.
Figure 18:
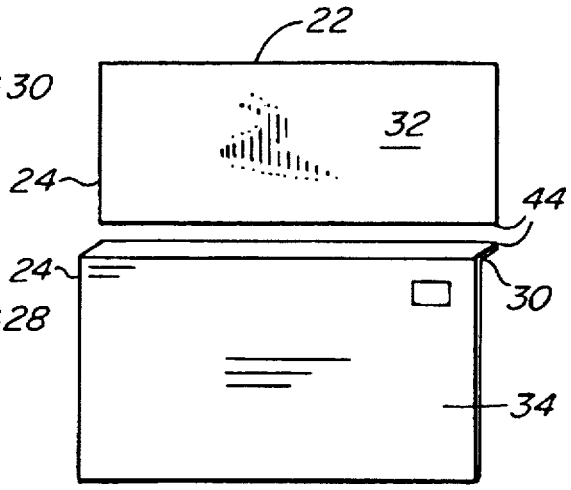
FIG. 18 shows the return envelope portion of the mailer of FIG. 1 after it has been severed from the rest of the mailer.
Figure 19:
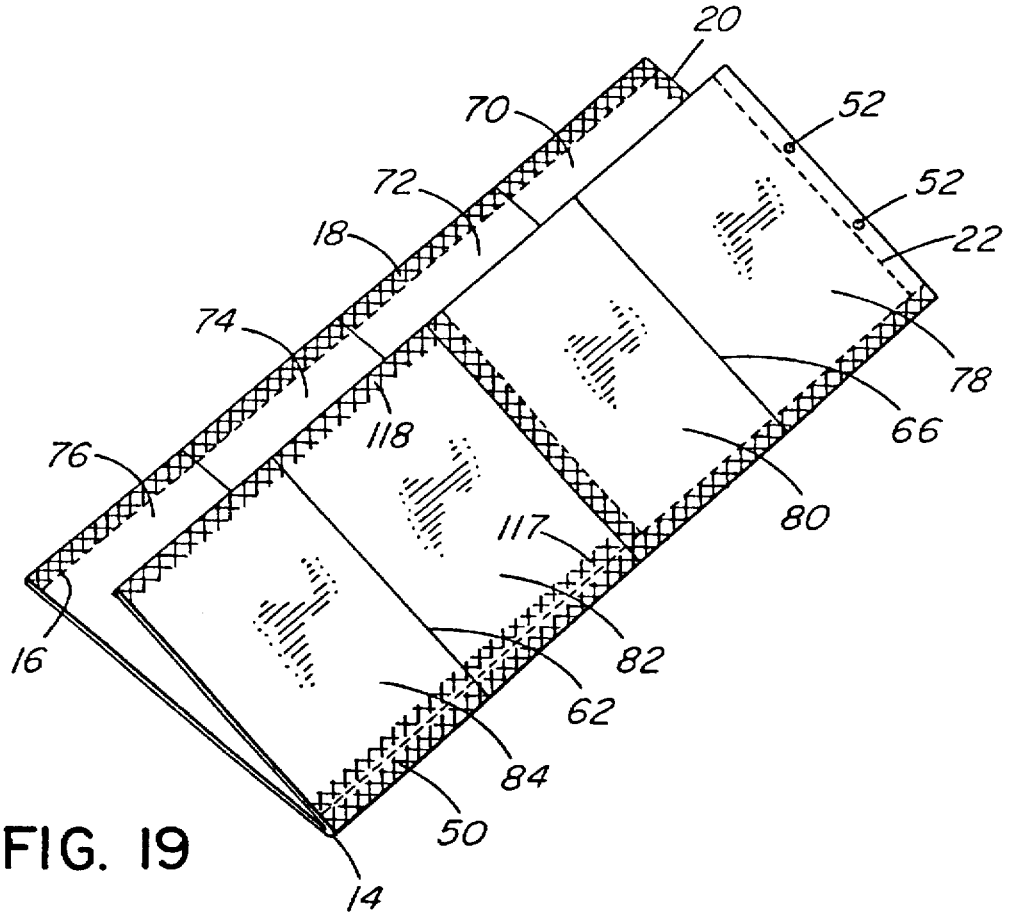
FIG. 19 is a perspective view of the mailer of FIG. 8 shown folded along its transverse fold line.
Figure 20:
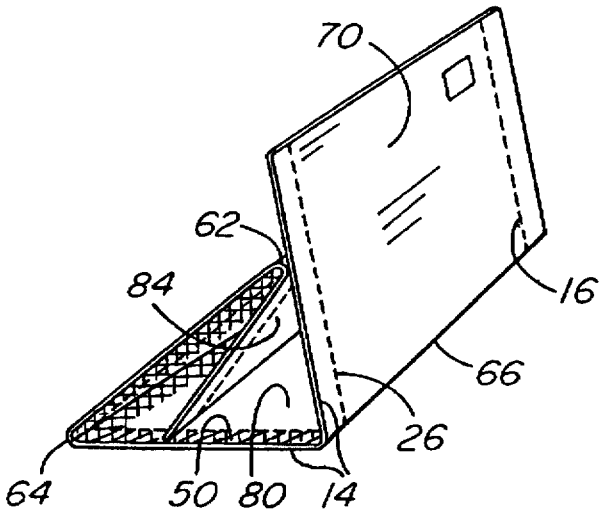
FIG. 20 is a perspective view of the mailer of FIG. 19 shown additionally folded about its three secondary fold lines.
Figure 21:
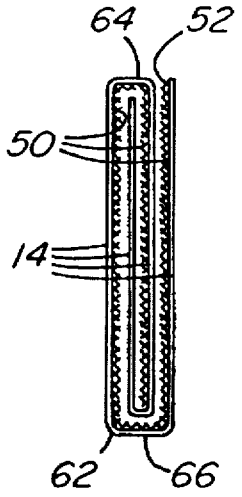
FIG. 21 is a cross section of the embodiment shown in FIG. 20 when folded flat.
Figure 22:
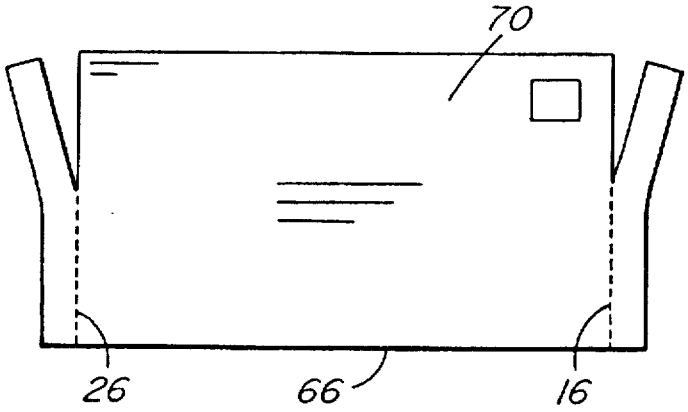
FIG. 22 is a front view of the mailer of FIG. 8 in a folded and sealed condition, and shown partially torn open.
Figure 23:
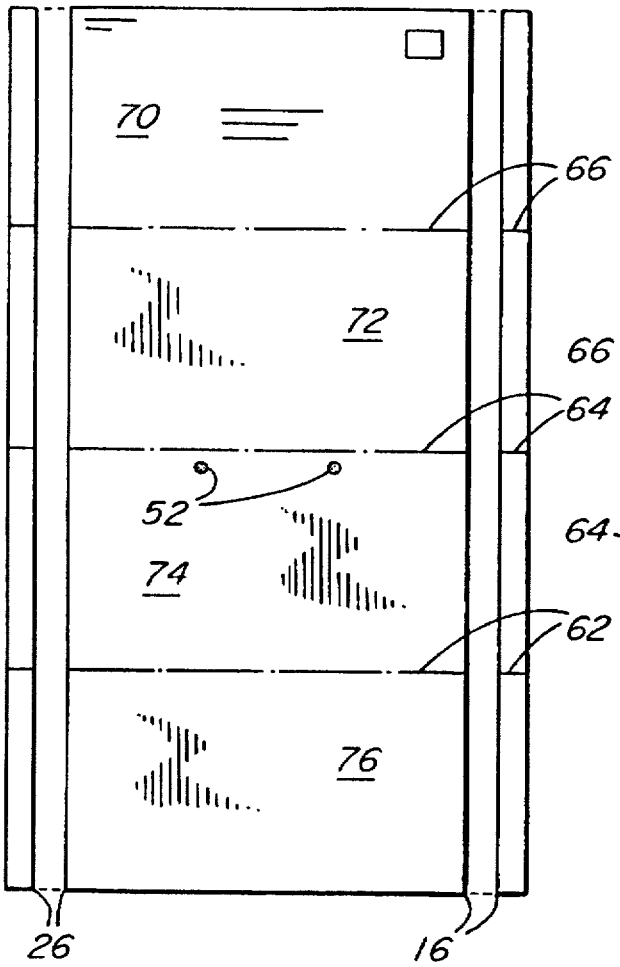
FIG. 23 is a plan view of the mailer of FIG. 22 showing the opposite perforated ends completely severed and the mailer being in an unfolded condition.
Figure 24:
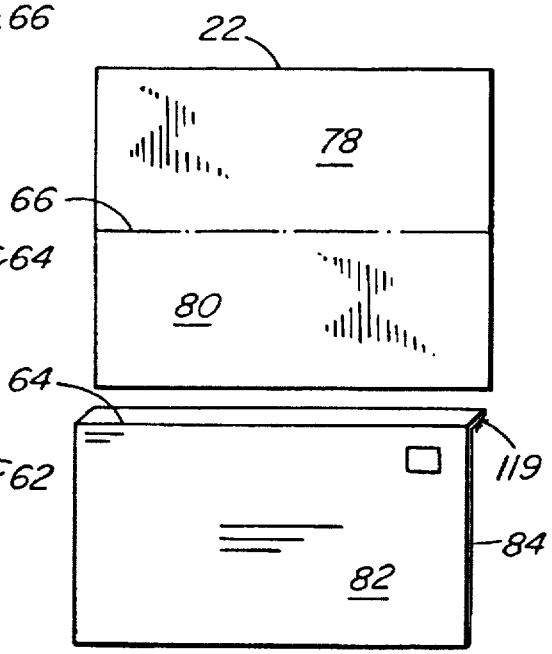
FIG. 24 shows the return envelope portion of the mailer of FIG. 8 after it has been severed from the rest of the mailer.
Figure 25:
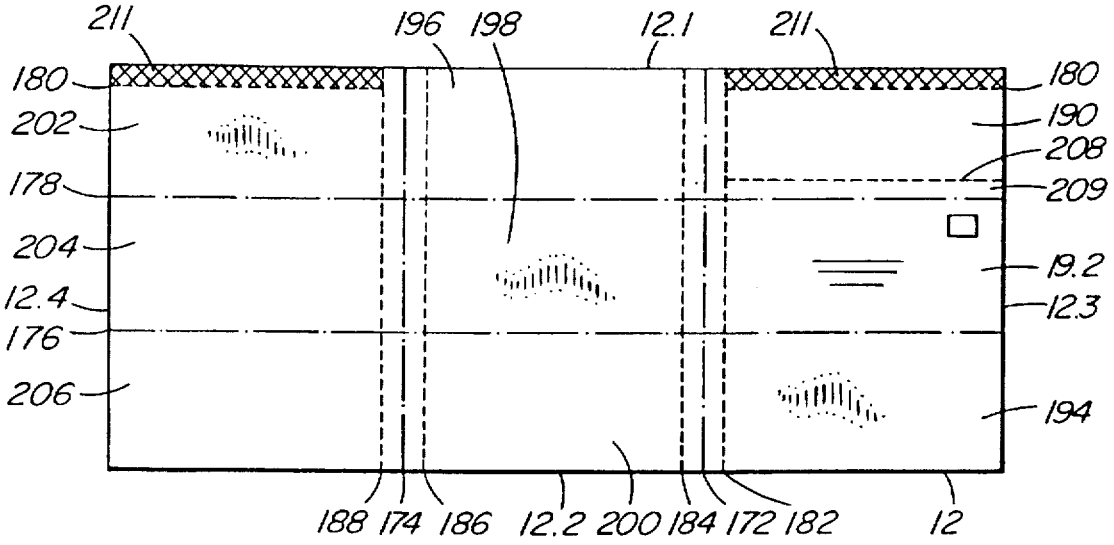
FIG. 25 is a plan view of the inner face of the single sheet mailer of FIG. 12.
Figure 26:
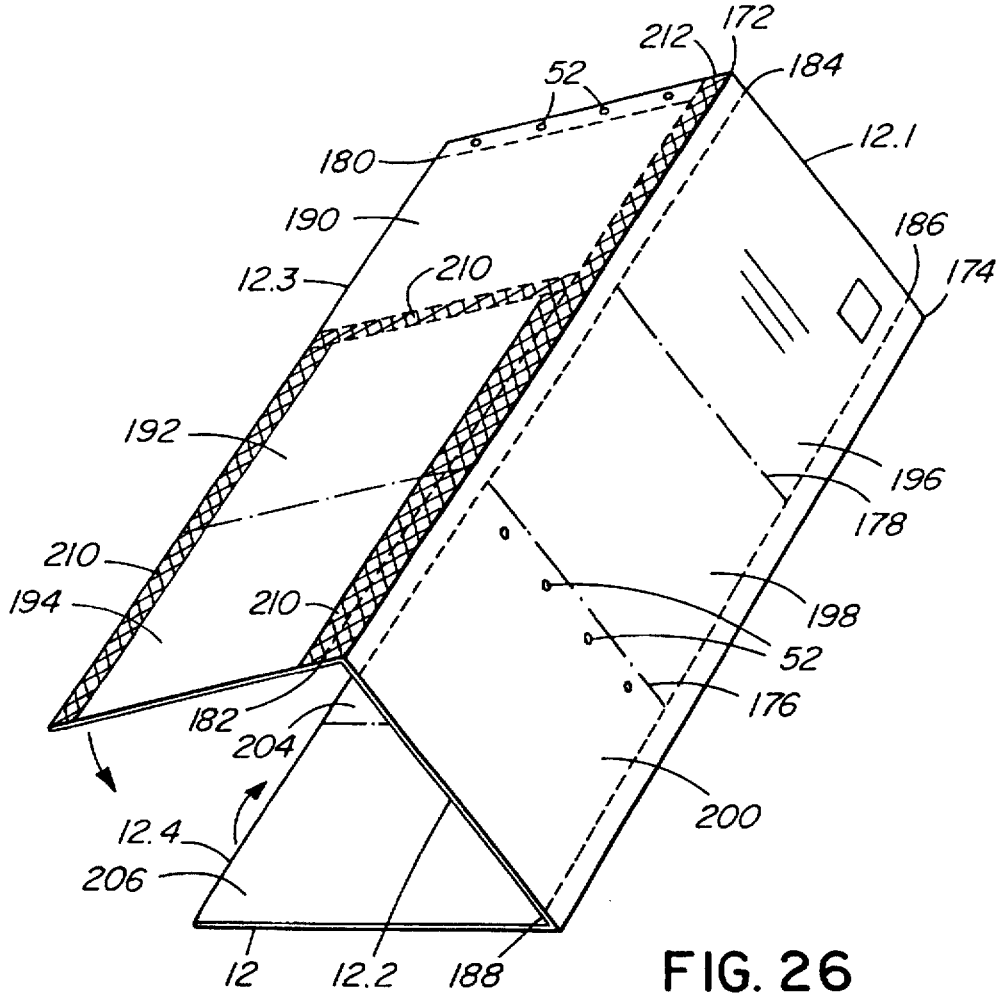
FIG. 26 is a perspective view of the mailer of FIG. 12 shown folded along its transverse fold lines.
Figure 27:
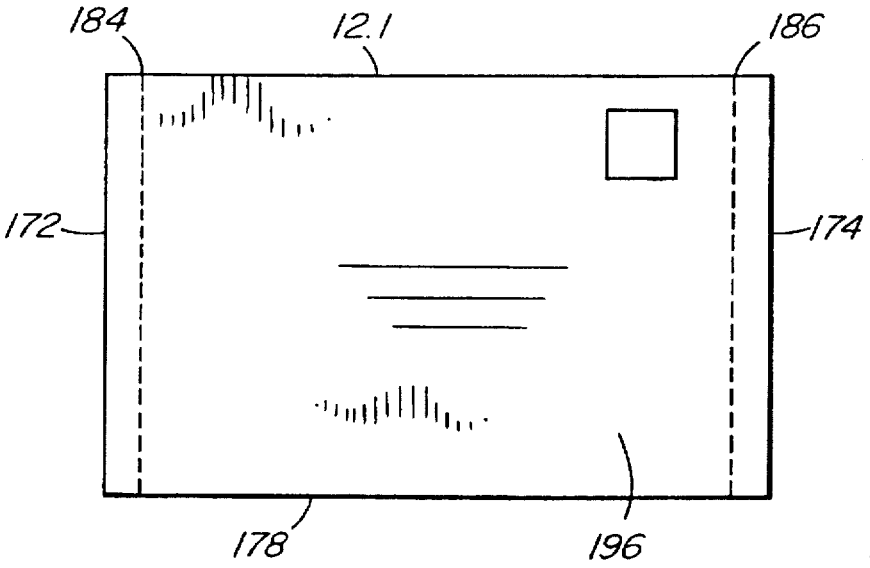
FIG. 27 is a front view of the mailer of FIG. 12 in a folded and sealed condition.
Figure 28:
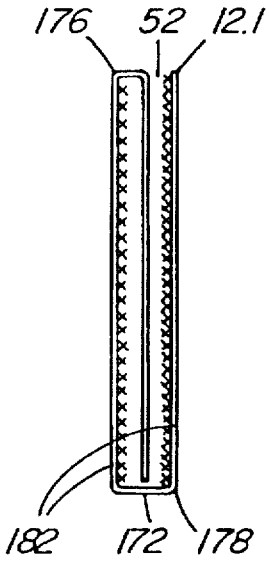
FIG. 28 is a cross-section of the embodiment shown in FIG. 12 when folded flat.
Figure 29:
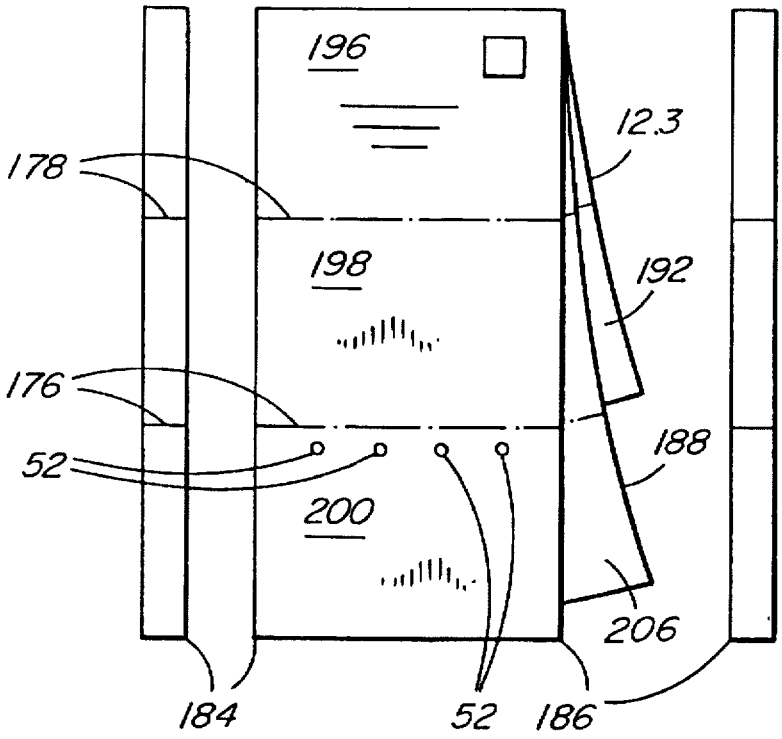
FIG. 29 is a side view of the mailer of FIG. 12 showing the opposite perforated ends completely severed and the mailer being in an unfolded condition.
Figure 30:
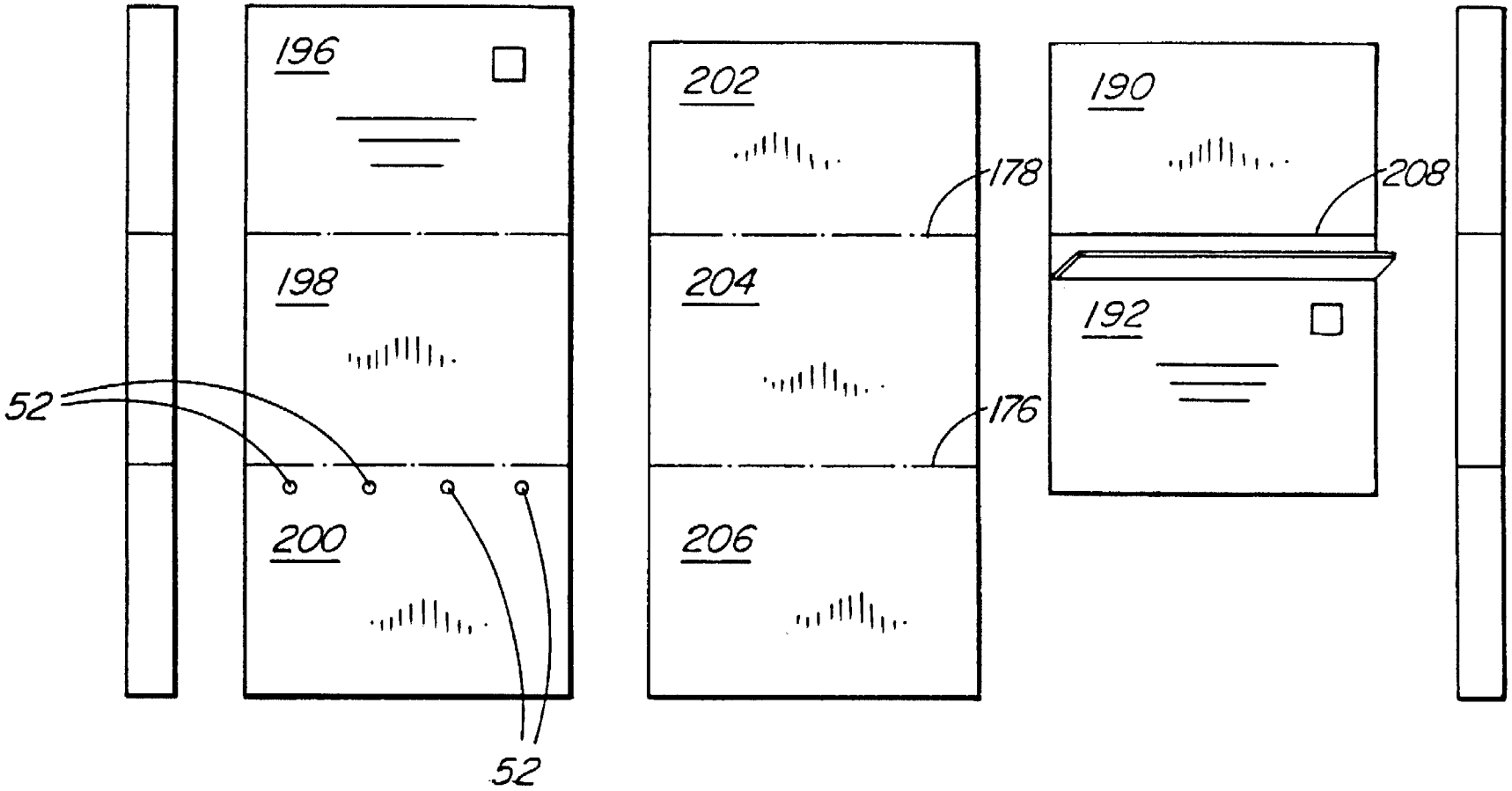
FIG. 30 shows the sections of the mailer of FIG. 12 completely severed from each other and showing a return envelope portion after it has been severed from the rest of the mailer.

With reference to FIG. 12, the outer face of a single sheet mailer 170 according to yet another embodiment of the invention is shown. The mailer 170 comprises a rectangular sheet 12 having a first pair of opposed ends 12.1 and 12.2 and second a pair of opposed ends 12.3 and 12.4. The sheet 12 has a pair of transverse folds 172 and 174 extending between the ends 12.1 and 12.2 and a pair of longitudinal folds 176 and 178 extending between the ends 12.3 and 12.4. The sheet 12 further has a line of perforation 180 extending along the end 12.1, two lines of perforation 182 and 184 adjacent the fold line 172 and two lines of perforation 186 and 188 adjacent the fold line 174 so that lines 182 and 184 and the lines 186 and 188 are superimposed when the sheet 12 is folded along the fold lines 172 and 174, respectively. The transverse and longitudinal folds divide the sheet 12 up into nine panels, indicated by reference numerals 190, 192, 194, 196, 198, 200, 202, 204 and 206.

In the embodiment shown in FIG. 12, a return envelope is formed by the panels 192 and 194. A return address is printed on the panel 192 on the inner face of the sheet 12, i.e. the face opposite to that shown in FIG. 12. A line of perforation 208 is provided in the panel 190 to form the flap 209 of the return envelope. Lines of remoistenable glue 210 are provided along the opposite transverse ends of the panels 192 and 194, as well as along the flap 209, as shown. An order form can conveniently be printed on the panel 190.

A glue line 211 is provided between the line of perforation 180 and the end 12.1 in order to seal the top of the mailer 170. Glue spots 52, similar to those in the other embodiments, are provided to seal the top of the mailer 170 after it has been folded along the longitudinal folds 176 and 178.

As can be seen, the panels are arranged in three vertical columns of three panels each. The panels in the two outer columns are slightly shorter than the panels in the central column, so that when the sheet 12 is folded on itself along the fold lines 172 and 174, the outer panels do not reach beyond the lines of perforation adjacent the opposite transverse fold line, i.e. the panels 190, 192 and 194 do not reach beyond the line of perforation 186 and the panels 202, 204 and 206 do not reach beyond the line of perforation 184. This is to enable the mailer 170 to be sealed along its opposite ends by means of glue lines 212 and 214.

It will be appreciated that the return envelope can be located on other panels, as desired or required by the circumstances. In addition, in expanded versions of this embodiment, four or more panels may be provided in each column by providing three or more longitudinal folds in the sheet 12.

As alternatives to the specific embodiments of the mailers 10, 60, 100, 114, 120, 150 and 200 described above, embodiments which are simply mirror images of the above-described embodiments can also be used.

Although all the above described embodiments incorporate return envelopes which are either preformed or formed by the recipient, it will be appreciated that the mailer need not include a return envelope. It may, for example, contain only printed information or it may incorporate a reply card instead of a return envelope.

While only preferred embodiments of the invention have been described herein in detail, the invention is not limited thereby and modifications can be made within the scope of the attached claims.

What is claimed is:

1. A folded single sheet mailer comprising a rectangular sheet having a first pair of opposed ends, a second pair of opposed ends, an outer face and an inner face, said sheet being folded on itself transverse to said first pair of ends along a pair of spaced transverse fold lines, a pair of superimposed lines of perforation adjacent each of said transverse fold lines, and said sheet further being folded along at least two longitudinal fold lines extending longitudinally of said first pair of ends to provide an outgoing envelope which is openable by tearing along said superimposed lines of perforation.

2. The mailer according to claim 1, wherein said transverse fold lines are substantially equidistant from said second pair of ends, respectively.

3. The mailer according to claim 2, further comprising a longitudinal line of perforation adjacent one of said first pair of ends.

4. The mailer according to claim 3, further comprising a glue line extending between said longitudinal line of perforation and said one of said first pair of ends.

5. The mailer according to claim 4, further comprising a pair of transverse glue lines, each transverse glue line extending between one of said transverse fold lines and one of said superimposed lines of perforation for sealing said outgoing envelope along one pair of its opposite ends.

6. The mailer according to claim 5, further comprising a plurality of spaced glue spots along one of said first pair of ends for sealing said outgoing envelope along its upper end.

* * * * *